US005603681A

United States Patent [19]

Olschansky et al.

[11] Patent Number: 5,603,681

[45] Date of Patent: Feb. 18, 1997

[54] PORTABLE MULTI-EXERCISE SYSTEM

[76] Inventors: Brad Olschansky; Scott Olschansky, both of 2003 Lake Park Dr., Apt. H, Smyrna, Ga. 30080

[21] Appl. No.: 546,986

[22] Filed: Oct. 23, 1995

[51] Int. Cl.[6] ..... A63B 21/02

[52] U.S. Cl. ..... 482/129; 482/123

[58] Field of Search ..... 482/121, 122, 482/123, 129

[56] References Cited

U.S. PATENT DOCUMENTS

| | | | |
|---|---|---|---|
| 2,777,439 | 1/1957 | Tuttle . | |
| 2,855,199 | 10/1958 | Noland et al. . | |
| 3,563,542 | 2/1971 | Wellman | 482/123 |
| 3,662,602 | 5/1972 | Weiss | 482/123 |
| 3,721,438 | 3/1973 | Kusmer . | |
| 4,208,049 | 6/1980 | Wilson . | |
| 4,226,415 | 10/1980 | Wright . | |
| 4,231,568 | 11/1980 | Riley et al. . | |
| 4,311,305 | 1/1982 | Lambert, Jr. et al. . | |
| 4,322,071 | 3/1982 | Lambert, Jr. et al. . | |
| 4,328,964 | 5/1982 | Walls . | |
| 4,349,192 | 9/1982 | Lambert, Jr. et al. . | |
| 4,349,193 | 9/1982 | Lambert, Jr. et al. . | |
| 4,349,194 | 9/1982 | Lambert, Jr. et al. . | |
| 4,465,274 | 8/1984 | Davenport . | |
| 4,492,375 | 1/1985 | Connelly . | |
| 4,500,089 | 2/1985 | Jones . | |
| 4,509,747 | 4/1985 | Martin | 482/123 |
| 4,546,971 | 10/1985 | Raasoch . | |
| 4,568,078 | 2/1986 | Weiss . | |
| 4,621,807 | 11/1986 | Stramer . | |
| 4,666,149 | 5/1987 | Olschansky et al. . | |
| 4,666,151 | 5/1987 | Chillier . | |
| 4,784,384 | 11/1988 | Deola . | |
| 4,902,006 | 2/1990 | Stallings . | |
| 5,074,551 | 12/1991 | Olschansky et al. . | |

*Primary Examiner*—Lynne A. Reichard

*Attorney, Agent, or Firm*—Morton J. Rosenberg; David I. Klein

[57] ABSTRACT

A portable multi-exercise system (10) is provided to generate a resistive force responsive to a force applied by a user. The system (10) includes a base frame member formed generally by a planar bottom frame portion (20) and a back frame portion (30). A rotation actuation mechanism (40) for reversibly imparting a torque about a rotational axis responsive to the force applied by the user is mounted to the base frame member, preferably to the back frame portion (30) thereof. A rotation transfer member (50) having a first portion (51) remaining coaxially aligned with the rotational axis and a second portion (55) pivotally displaceable about that rotational axis in response to the torque is coupled to the rotation actuation mechanism (40). At least one flexible tension member (60) is connected between the base frame member and this second portion (55) of the rotation transfer member (50) to provide the resistive force necessary to oppose the torque reversibly imparted by the rotation actuation mechanism (40). The flexible tension member (60) is connected to the second portion (55) of the rotation transfer member (50) by a pivotal coupling. In an alternate embodiment, first (60) and second (60') flexible tension members are connected between the base frame and the second portion (55) of the rotation transfer member (50) in such a manner that the first tension member (60) imparts at least one component of force opposing a component of force imparted by the second tension member (60').

11 Claims, 8 Drawing Sheets

PORTABLE MULTI-EXERCISE SYSTEM

BACKGROUND OF THE INVENTION

1. Field of the Invention

This invention is directed to a multi-exercise system. More specifically, this invention is directed to a portable multi-exercise system by which a user may exercise different portions of his or her body by making a simple adjustment to the system, appropriately re-positioning his or her body relative to the system, and performing the required exercise movements thereafter.

With the current widespread awareness of the significant health benefits afforded by regular exercise, daily exercise has become a matter of high priority to many members of the general public. A major obstacle faced by most in their endeavor to follow a regular exercise regimen is the lack of ready access to equipment that enable them to exercise different portions of the body. Ideally, such access would be gained through an in-home gym facility equipped with various exercise machines and implements for exercising different portions of the body. For most, however, financial, spatial, and other constraints preclude a realization of such an in-home facility.

Versatile machines reconfigurable to enable various exercises thereon exist. Those machines, however, typically include complex arrangements of mechanical parts and require complicated series of adjustments to reconfigure the machine for different exercises. Where such complexity is not present, the machines are either undesirably limiting in the number of different exercises that may be performed on them, or are physically of such substantial mass and dimensional extent that they may be fully utilized only in certain wide-open areas of a given home, and are hardly movable, let alone portable. An effective substitute for a fully-equipped in-home gym facility that is versatile, simple, and portable enough to offer a user optimum access to significant and regular exercise of the variety and quality he or she would be able to perform in such a gym facility is therefore not realized in existing reconfigurable machines.

2. Prior Art

Multi-exercise systems and methods of operation are known in the prior art. In particular, the closest prior art known includes U.S. Pat. Nos. 5,074,551 and 4,666,149, which are generally directed to reconfigurable systems for exercising various portions of the user's body. Additional prior art known to Applicant includes U.S. Pat. Nos. 2,777,439; 2,855,199; 3,721,438; 4,208,049; 4,226,415; 4,328,964; 4,492,375; 4,500,089; 4,546,971; 4,568,078; 4,231,568; 4,311,305; 4,322,071; 4,349,192; 4,349,193; 4,349,194; 4,465,274; 4,621,807; 4,666,151; 4,784,384; 4,902,006; and, Netherlands Patent 8005681.

None of the prior art multi-exercise systems provide for the versatility, simplicity, and portability in the unique manner provided by the subject portable multi-exercise system. In the prior art systems shown in U.S. Pat. Nos. 4,666,149 and 5,074,551, an adjustable rotation actuation bar is employed; however, the systems embody a number of features that render them significantly different from the subject portable multi-exercise system. First, the systems are quite substantial in mass and dimensional extent. As such, they may be re-located by a single user only with great coordination and effort and, therefore, are certainly not portable. Second, the basic configuration in each system is such that a user may not exhaust the full capabilities of the system without constantly having to re-adjust or temporarily remove a bench assembly. In a practical sense, then, those systems are not as versatile as the subject portable multi-exercise system wherein no such cumbersome manipulations—likely to dissuade a user from performing particular exercises—are necessary to fully utilize the system. Finally, the exercise mechanisms of those prior art systems lack the simplicity found in the subject portable multi-exercise system in that user-applied force in those systems is exerted on the resistive force mechanism along a fixed linear direction, the user-actuated rotation having been translated to linear motion by a pulley device. Hence, the structural requirements of such exercise mechanisms require more mechanical parts in those systems than in the subject portable multi-exercise system, and obviate the need found in the subject portable multi-exercise system for a pivotal coupling between a resistive force-providing tension member and a rotation transfer member.

SUMMARY OF THE INVENTION

The portable multi-exercise system of the invention combines into one machine the wide versatility, the simplicity, and the portability desired in, but not seen in prior art exercise machines. The system provides resistive force responsive to a force applied by a user. It includes a base frame member having a planar bottom frame portion which supports the user and a back frame portion which supports the exercise mechanisms. Those mechanisms include a rotation actuation means which converts the force applied by the user into a torque about a rotational axis. This torque is imparted on a first portion of a rotation transfer member which is secured to the rotation actuation means such that the first portion to which torque is transferred remains coaxially aligned with the rotational axis.

A flexible tension member which provides the force resisting the torque generated in response to a user's applied force is connected between the base frame member and the rotation transfer member. The flexible tension member is connected to the rotation transfer member at a second portion which is displaced from the first portion thereof by a given distance. The point of connection between the flexible tension member and that second portion of the rotation transfer member forms a pivotal coupling which prevents the generation of undesirable tensile forces on and the undesirable coiling of the flexible tension member during the movement of the rotation transfer member.

In this configuration, the flexible tension member operates to provide a resistive force to oppose torque generated in either of the two angular directions about the rotational axis of rotation actuation means. This greatly enhances the versatility of the portable multi-exercise system, since a user may perform a variety of 'pushing' or 'pulling' exercises even without system reconfiguration, simply by repositioning his or her body.

An actuation bar is coupled to the rotation actuation means. It is this actuation bar that the user 'pushes' or 'pulls' to actuate the exercise mechanisms of the system. The actuation bar is adjustable in its initial angular position relative to the rotational axis to facilitate a wide range of exercises, thus further enhancing system versatility.

The flexible tension member is of sufficient strength to oppose the expanding force exerted thereon by the user's manipulation of the actuation bar. The flexible tension member is removably coupled to the base frame member and the rotation transfer member such that additional flexible tension members may be freely added and removed to either increase or decrease the resistive force derived therefrom.

DESCRIPTION OF THE PREFERRED EMBODIMENTS

Figure 1:
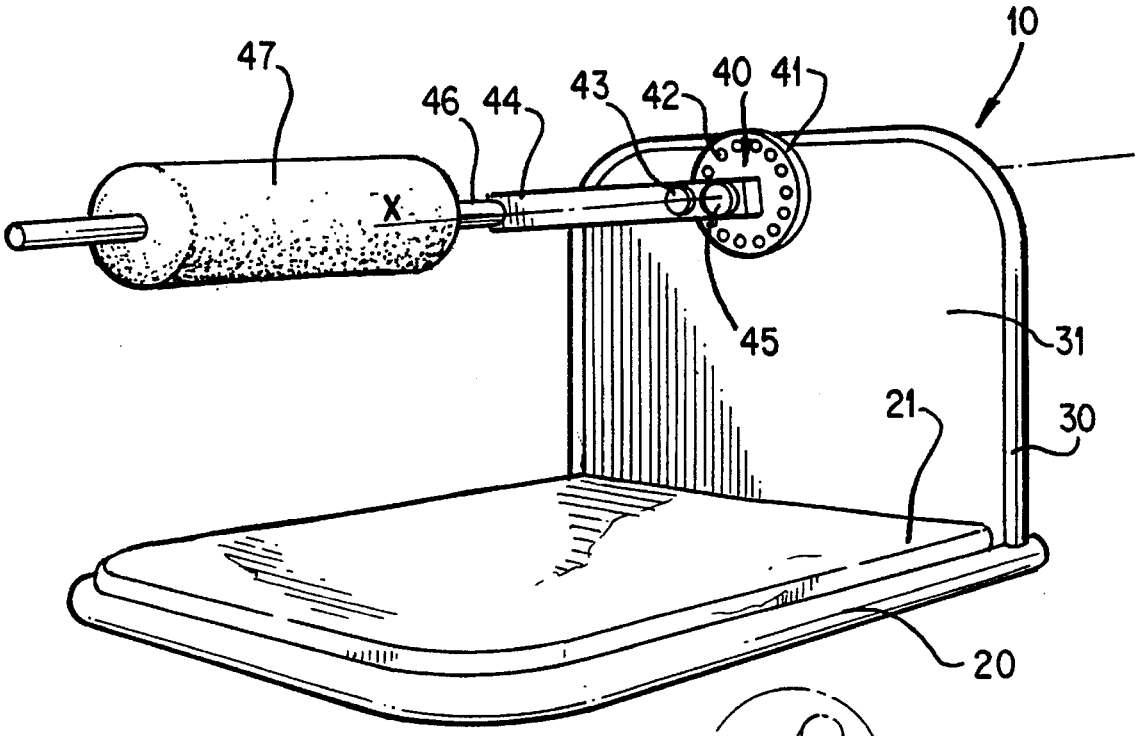
FIG. 1 is a perspective view of the preferred embodiment of the present invention.
Figure 2:
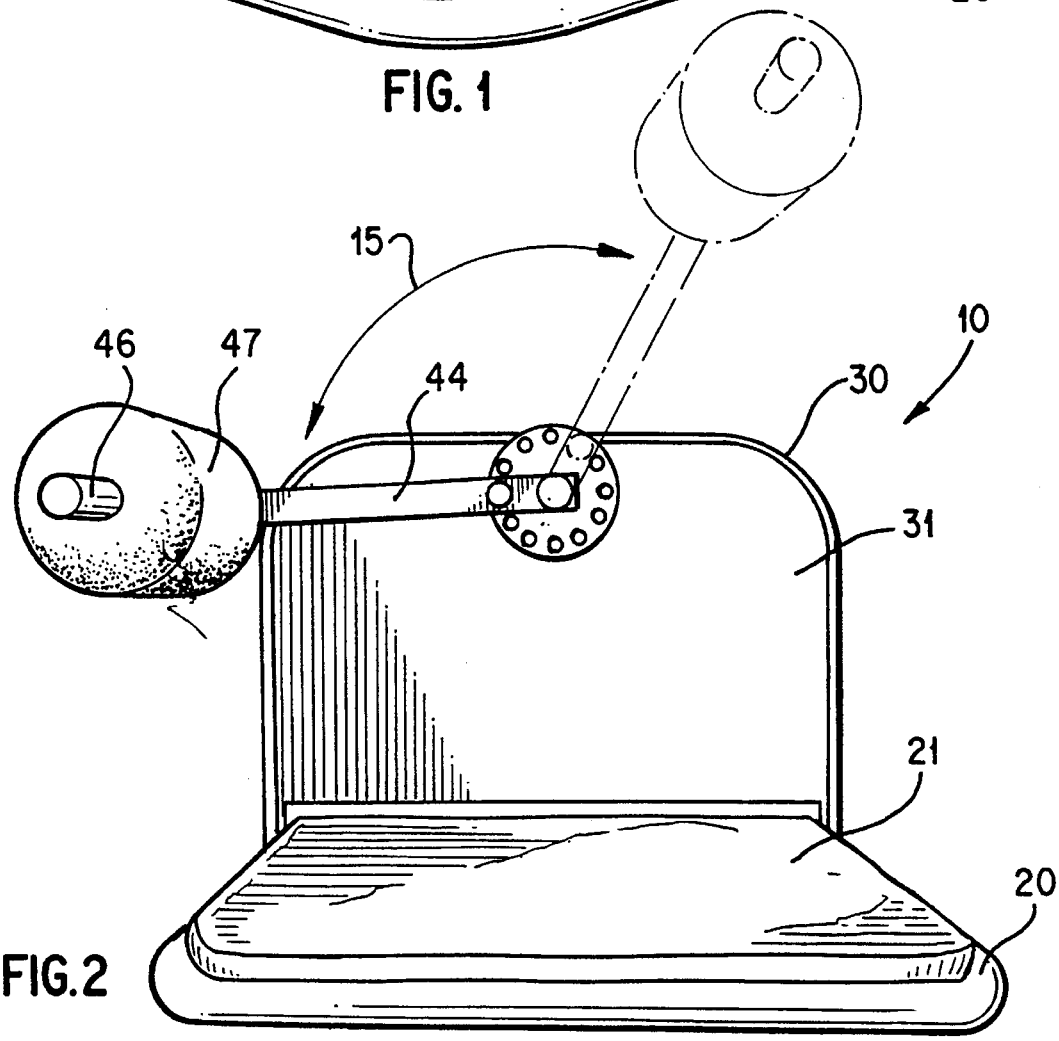
FIG. 2 is a front perspective view of the preferred embodiment of the present invention illustrating the movement direction of an actuation bar.

Referring now to FIGS. 1–4, there is shown portable multi-exercise system 10 for providing a resistive force responsive to a force applied by a user. In overall concept, portable multi-exercise system 10 allows a user to apply a rotational displacement to actuation bar 44, via handle 46 and handle pad 47, in the direction shown by the arcuate directional arrow 15. Through this rotational displacement, as will be seen in following paragraphs, a torque is generated about a rotational axis. A resistive force within the system opposes this torque to enable a given exercise.

System 10 is, moreover, directed in general concept to an exercising mechanism which enables a wide variety of different exercises to be performed thereon. By quickly and simply re-adjusting the initial position of actuation bar 44 and re-positioning his or her body accordingly, a user may perform a multitude of exercises to develop various muscles of his or her body.

Portable multi-exercise system 10 comprises a base frame member formed by a bottom frame portion 20 and a back frame portion 30. Back frame portion 30 may either be permanently coupled to bottom frame portion 20, for instance, by welding, or may be releasably, though securely, joined to bottom frame portion 20 by a fastening means (not shown). To this end, back frame portion 30 includes a bottom support segment 32 which forms flush, contiguous contact with back segment 22 of bottom frame portion 20 to provide a stable structural interface between back and bottom frame portions 30 and 20. When this interface is formed to be releasable, additional means may be employed to realize a collapsible base frame member without exceeding the scope of the invention.

Bottom frame portion 20 is preferably, substantially overlaid with base pad member 21 formed of a resilient material such as foam rubber to provide a cushioned surface for the user. Back frame portion 30 is, preferably, substantially overlaid with a solid panel 31, the specific composition of which is not important to the invention; to provide greater strength and rigidity to back frame portion 30, as well as to provide a more pleasing appearance therefor.

Figure 3:
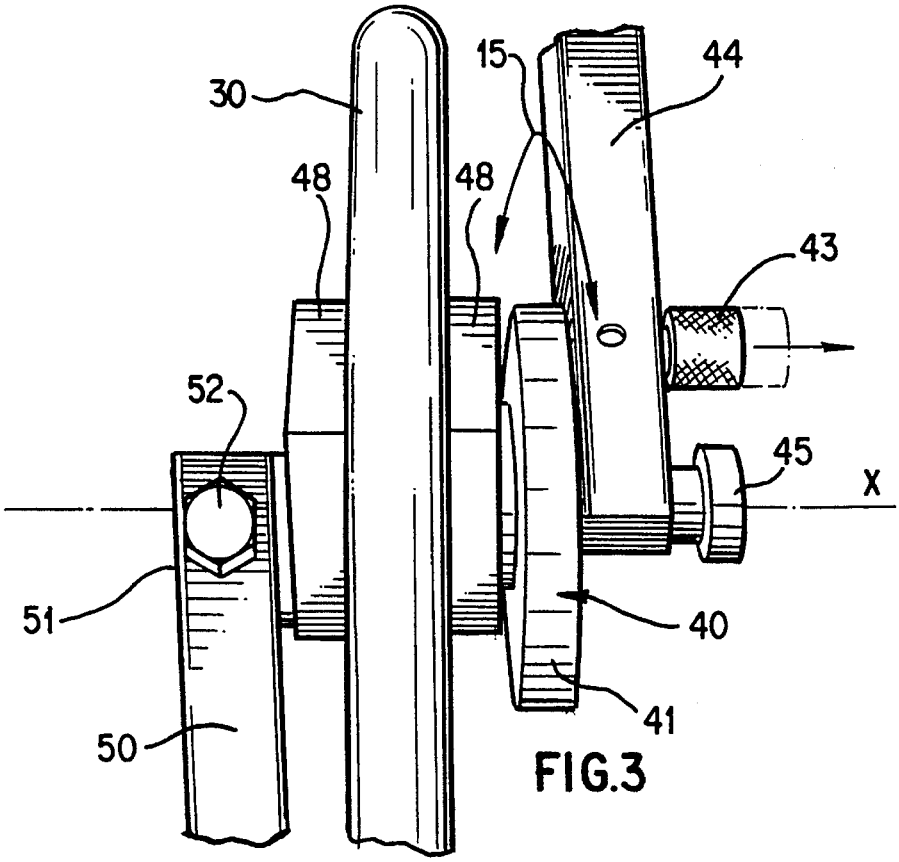
FIG. 3 is a side perspective view, partially cut-away, of the rotation actuation means of the preferred embodiment of the present invention.

Supported on the base frame member, preferably on back frame portion 30 and its overlaying panel 31, is rotation actuation mechanism 40. Rotation actuation mechanism 40 includes actuation disk 41 rotatably mounted to back frame portion 30 and its overlaying panel 31 via mounting block 48, as shown in FIG. 3, to rotate about a rotational axis indicated by the dashed line marked X. Actuation disk 41 has formed around the peripheral portion of the planar surface thereof facing away from solid panel 31, a plurality of evenly-spaced actuation bar-setting openings 42.

Extending coaxially through actuation disk 41 and mounting block 48 is pin member 45, the axial center of which defines the rotational axis X of rotation actuation means 40. Pin member 45 captures actuation bar 44 to actuation disk 41 such that actuation bar 44 may be pivoted 360 degrees about rotational axis X, to select its orientation relative to actuation disk 41, or its initial angular position. Once this initial angular position is selected, actuation bar setting pin 43 which extends through actuation bar 44, as shown in FIG. 3, is caused to engage an actuation bar setting opening 42 and thereby lock actuation bar 44 in the selected initial angular position.

Actuation bar setting pin 43 is preferably captured in spring-biased manner within a through opening formed in actuation bar 44 so as to minimize the probability of its dislodging from opening 42 during use of system 10. As indicated by the arrow in FIG. 3, a user must first forcibly withdraw actuation bar setting pin 43 from engagement with a given actuation bar setting opening 42 before actuation bar 44 may be pivoted along the arcuate arrow shown in FIG. 3 to change its initial angular position with respect to actuation disk 41. After the actuation bar 44 is pivoted to its new initial angular position, release setting pin 43 locks actuation bar 44 in that new position.

Coupled to the terminal portion of pin member 45 which projects through mounting block 48 is rotation transfer member 50. Rotation transfer member 50 is preferably in the form of a rigid, elongate bar transversely mounted onto the terminal portion of pin member 45 and secured thereto by fastening means 52, as shown in FIG. 3. The resulting configuration enables rotation transfer member 50 to be pivoted at a first portion 51 thereof about rotational axis X. This enables a second portion 55 of rotation transfer member 50 distal from first portion 51 to incur pivoted movement along the arcuate arrows shown in FIG. 4 responsive to the driving rotation of actuation disk 41 shown by the arcuate arrows of FIG. 3.

Figure 4:
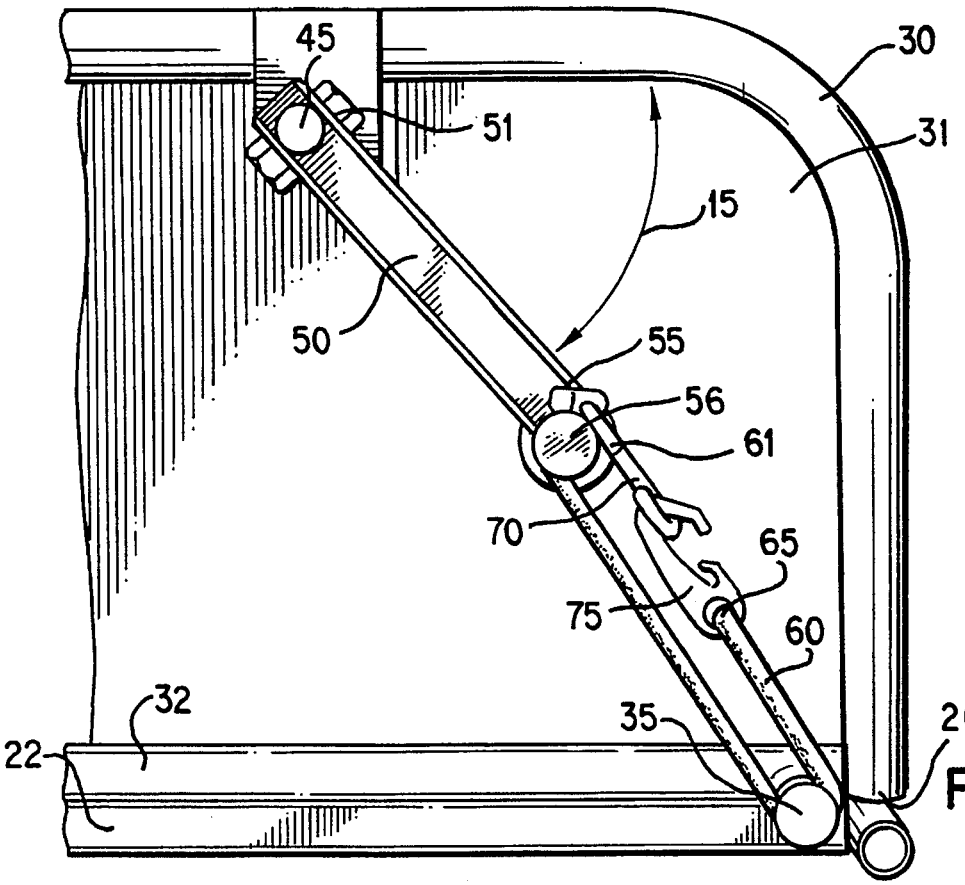
FIG. 4 is a back perspective view, partially cut-away of the preferred embodiment of the present invention illustrating the movement direction of a rotation transfer member.

Second portion 55 of rotation transfer member 50 includes pivotal coupling means 56 which, in the preferred embodiment, engages an inner portion of at least one flexible tension member 60. As shown in FIG. 4, first and second ends 61, 65 of flexible tension member 60 are respectively coupled to first and second hook members 70, 75. First and second hook members provide a releasable connection of first and second ends 61, 65 to form a continuously looped configuration for each tension member 60.

The continuous loop configuration of tension member 60 affords simplicity in the necessary pivotal coupling means 56. As second portion 55 of rotation transfer member 50 moves along the direction indicated by the arcuate arrows 15 of FIG. 4, pivoting of flexible tension member 60 with respect to second portion 55 is necessary if the formation of unnecessary tensile forces on flexible tension member 60 and motion-disruptive coiling of flexible tension member 60 about rotation transfer member 50 are to be avoided. The pivoting that occurs in the preferred embodiment shown in FIG. 4 is provided by the sliding engagement of an inner portion of the looped tension member 60 with pivotal coupling means 56. Given the sliding engagement afforded by the looped tension member 60, pivotal coupling means 56 may simply be a substantially normal projection from second portion 55 of rotation transfer member 50 having a formation, or other means to prevent the escape of tension member 60 from engagement therewith. Relatively movable parts, the coupling of which often degrades structural integrity, are not necessary with this configuration, whereby flexible tension member 60 forms an endless loop about pivotal coupling means 56 and base coupling means 35 of the base frame member.

Note that while the preferred embodiment employs no relatively movable parts in coupling mechanism 56, whether or not relatively movable parts are included in pivotal coupling means 56 is unimportant to the invention, as the invention comprehends both cases. It is important in this regard only that the coupling of flexible tension member 60 to second portion 55 of rotation transfer member 50 be a pivotal coupling.

Flexible tension member 60 is preferably formed of an elastic material, such as rubber, plastic, and other similar materials, but the particular material from which flexible tension member 60 is formed is not important to the invention. The only requirement in this regard is that the flexible tension member be expandable, and that it exert a resistive force when expanded. The invention comprehends that other structures, such as a mechanical spring, for instance, may serve as flexible tension member 60 as long as minor accommodating changes are also implemented in a given embodiment.

Only one flexible tension member 60 is necessary for operation of portable multi-exercise system 10; however, it may be desirable to add additional flexible tension members 60 to augment the overall resistive force to be encountered by a user. Any suitable means, for instance extending the relevant dimensions of pivotal coupling mechanism 56 and base engagement mechanism 35 by an appropriate amount or varying the shapes thereof, to facilitate additional tension members 60 may be employed. More simply, where flexible tension member 60 is removable, as in the preferred embodiment, augmentation of the resistive force provided by flexible tension member 60 may be realized by replacing a given flexible tension member 60 with another flexible tension member 60 of greater tension.

Figure 5:
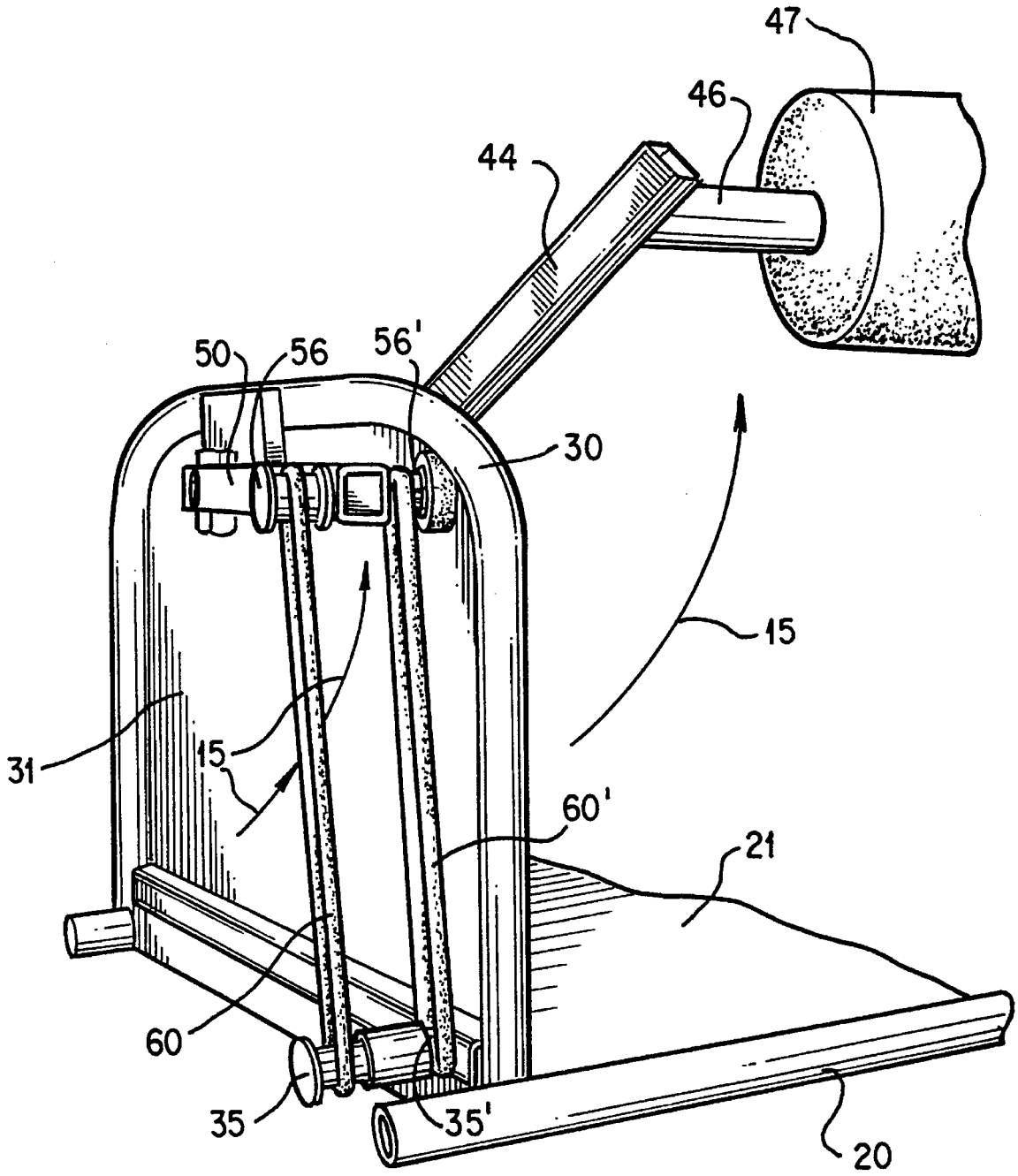
FIG. 5 is a perspective view, partially cut-away, of an alternate embodiment of the present invention.

Referring now to FIG. 5, there is shown an alternate embodiment of portable multi-exercise system 10, the same reference numerals used previously to indicate given elements being used herein to indicate like elements. In this embodiment, pivotal coupling mechanism 56 and base coupling mechanism 35 are formed respectively with extended sections 56' and 35' so as to facilitate the coupling of a second flexible tension member 60'. The second flexible tension member 60' not only increases the overall resistive force that may be Generated within portable multi-exercise system 10, it facilitates the variability of that resistive force, as it may be removed without difficulty to lessen the resistive force without elimination of the force completely.

Figure 6:
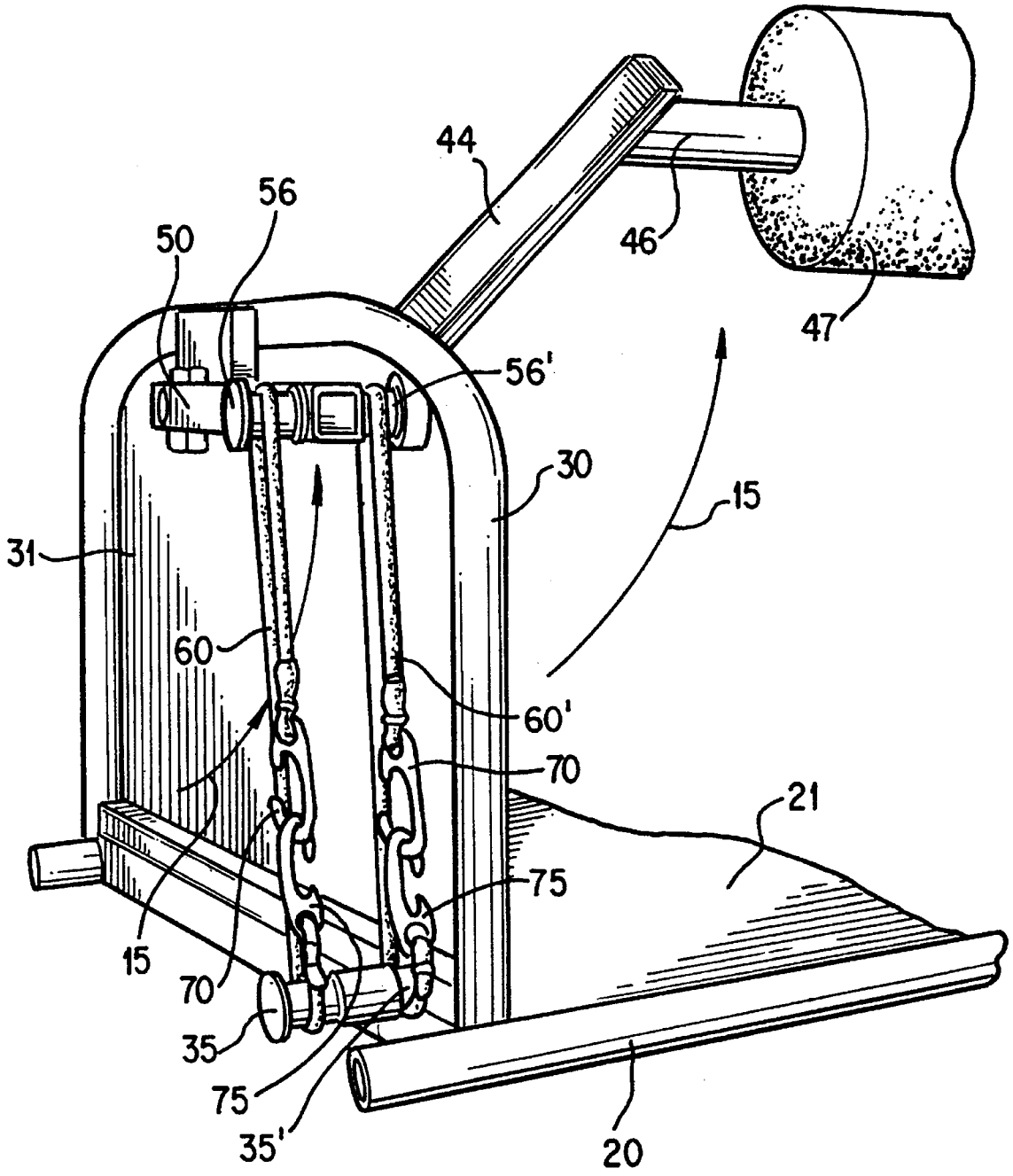
FIG. 6 is a perspective view, partially cut-away, of a second alternate embodiment of the present invention.

Note that flexible tension members 60 and 60' of FIG. 5 do not have coupled to the respective ends thereof hook members 70 and 75 shown in FIG. 6. Each flexible tension member 60, 60' is itself either an integrally-formed endless loop or else has its ends fused together to form a permanent endless loop. This is yet another variation which does not detract from the essential function of the invention.

The flexible tension members 60 and 60' of FIG. 5 may also be a pair of flexible tension members of the kind employed in the preferred embodiment. This is shown in FIG. 6, wherein each flexible tension member 60, 60' has coupled to its respective ends of hook members 70, 75 which are releasably joined to form a conveniently-removable continuous loop.

Figure 7:
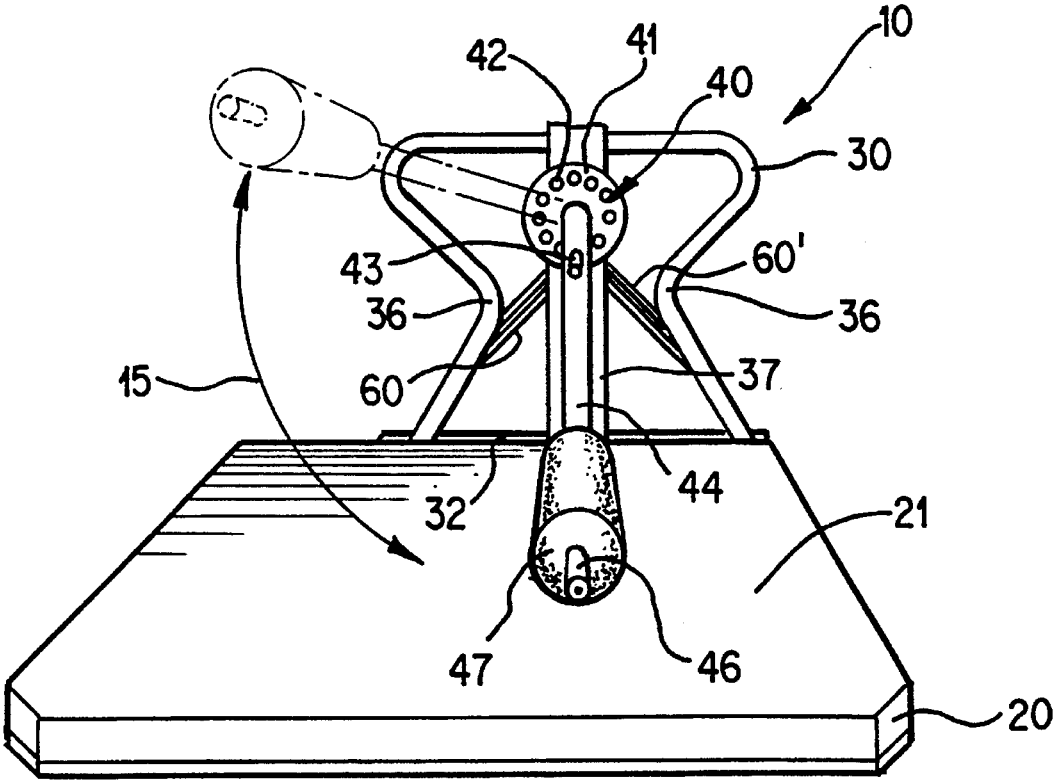
FIG. 7 is a front perspective view of a third alternate embodiment of the present invention illustrating the movement direction of an actuation bar.
Figure 8:
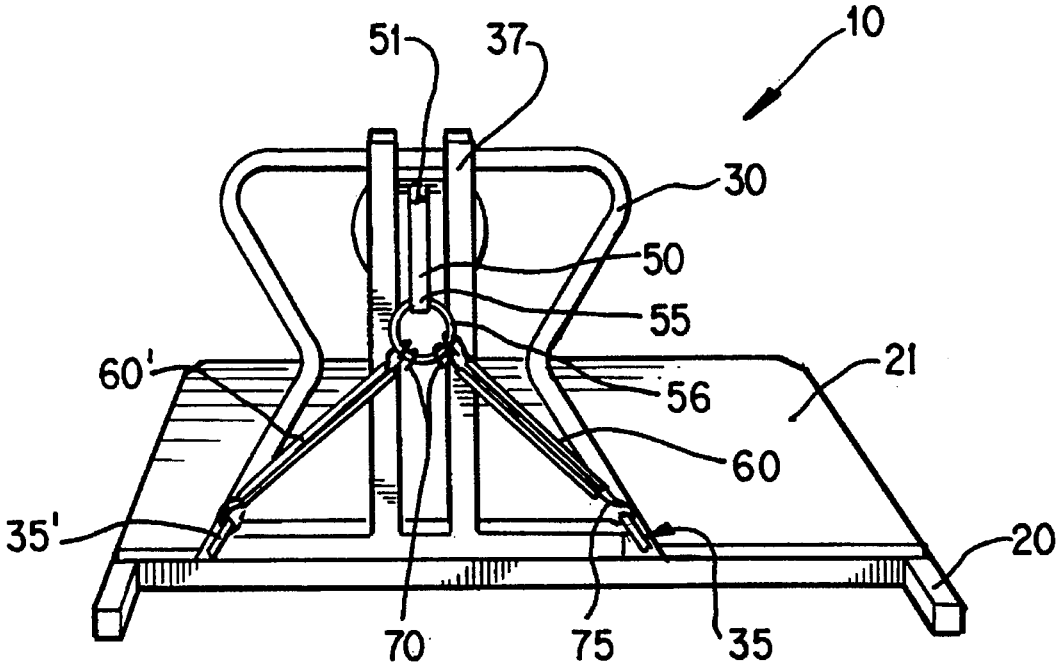
FIG. 8 is a back perspective view of the third alternate embodiment of the present invention.

Referring now to FIGS. 7 and 8, there is shown another embodiment of portable multi-exercise system 10 with the reference numerals previously used to indicate given elements being used herein to indicate like elements. In this embodiment, operation of the exercise mechanisms are essentially the same as in the previously-described embodiments. The main differences are in the structural configuration of back frame portion 30 of the base frame member and in the orientation and coupling of flexible tension members 60 and 60'. As shown, back frame portion 30 of the base frame member is formed with a pair of tapered leg segments 36, so formed to optimize the overall structural integrity in withstanding the forces exerted by flexible tension members 60 and 60'. A back frame post 37 extends from the top horizontal segment of back frame portion 30 to bottom support segment 32 thereof. Back frame post 37 is welded or otherwise securely fastened in place to stably support the rotatably mounted rotation actuation mechanism 40.

Also mounted to back frame post 37 on the side opposing that side to which actuation disk 41 of rotation actuation means 40 is mounted is rotation transfer member 50. As shown in FIG. 8, pivotal coupling mechanism 56 in this embodiment comprises a rigid ring formed onto the second portion 55 of rotation transfer member 50. At least a pair of flexible tension members 60 and 60' are pivotally coupled to pivotal coupling ring 56 via hook members 70. The sliding engagement of hook members 70 with pivotal coupling ring 56 avoids the formation of unnecessary tensile forces on flexible tension members 60, 60' and prevents their motion-disruptive coiling as rotation transfer member 50 advances along its pivotal movement about the rotational axis X of rotation actuation means 40.

At least a pair of flexible tension members 60, 60' are coupled to pivotal coupling ring 56 and extend therefrom, respectively, to couple with base coupling means 35 and 35'. Flexible tension members 60 and 60' are caused thereby to be oriented in such a manner that at least one component of the resistive force imparted by flexible tension member 60 continuously opposes a component of resistive force imparted by flexible tension member 60'. This results in a consistent exertion of resistive force responsive to the force applied by a user. Absent the opposing flexible tension member 60', the resistive force imparted by flexible tension member 60 (and any additional flexible tension members positioned in parallel therewith) to oppose torque in one direction about rotational axis X would, initially at least, be less than the resistive force imparted to oppose the torque in the other rotational direction about rotational axis X. The presence of flexible tension member 60' substantially equates the resistive force that would oppose torque in either of the two rotational directions about the rotational direction X.

Additionally, as can be seen in FIGS. 7 and 8, flexible tension members 60 and 60' dictate against a dead spot region since resistive forces in differing directions maintains a displacement force, thus, essentially providing the elimination of a dead spot during rotation of handle 46. The positional placement of members 60, 60' also provides for a relatively linearly increasing resistive force as a function of angular displacement of handle 46.

Figure 9:
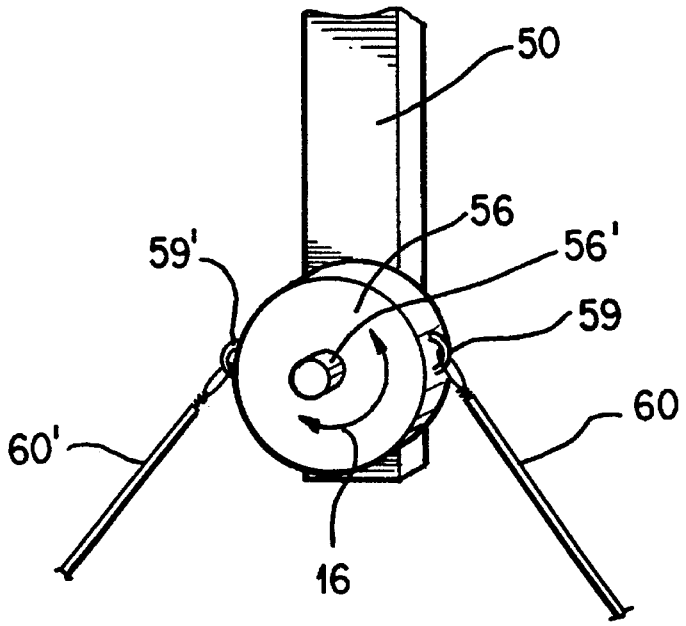
FIG. 9 is a perspective view, partially cut-away, of an alternate pivotal coupling means of the kind employed in the third alternate embodiment of the present invention.
Figure 10:
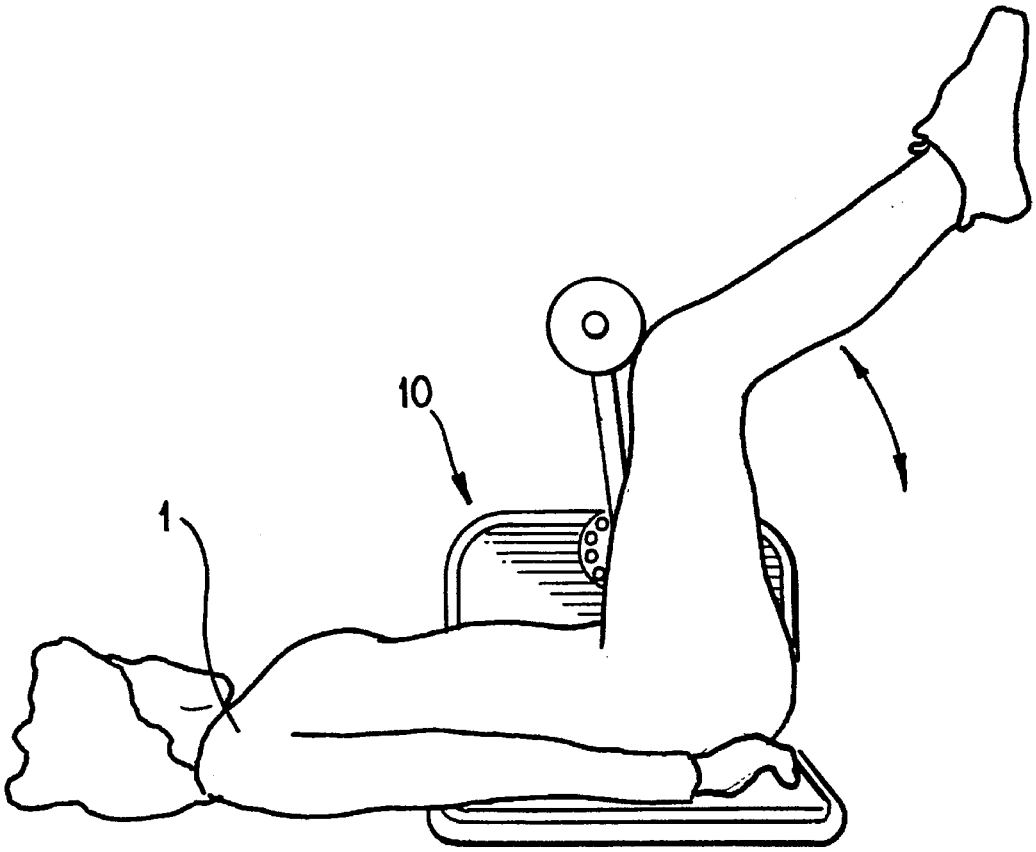
FIG. 10 is a front perspective view of a user performing a first exercise on the preferred embodiment of the present invention.
Figure 11:
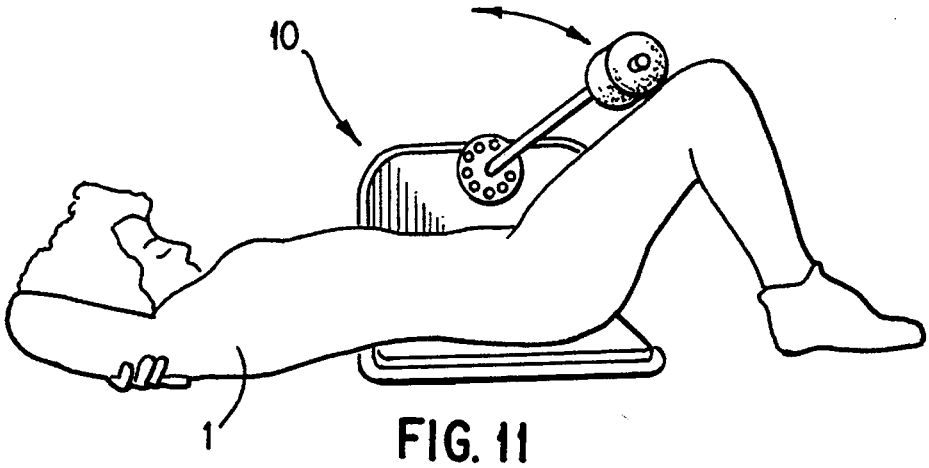
FIG. 11 is a front perspective view of a user performing a second exercise on the preferred embodiment of the present invention.
Figure 12:
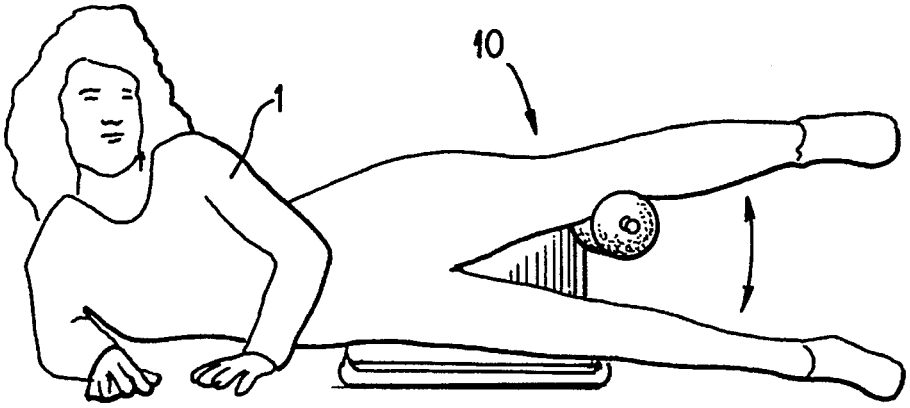
FIG. 12 is a front perspective view of a user performing a third exercise on the preferred embodiment of the present invention.
Figure 13:
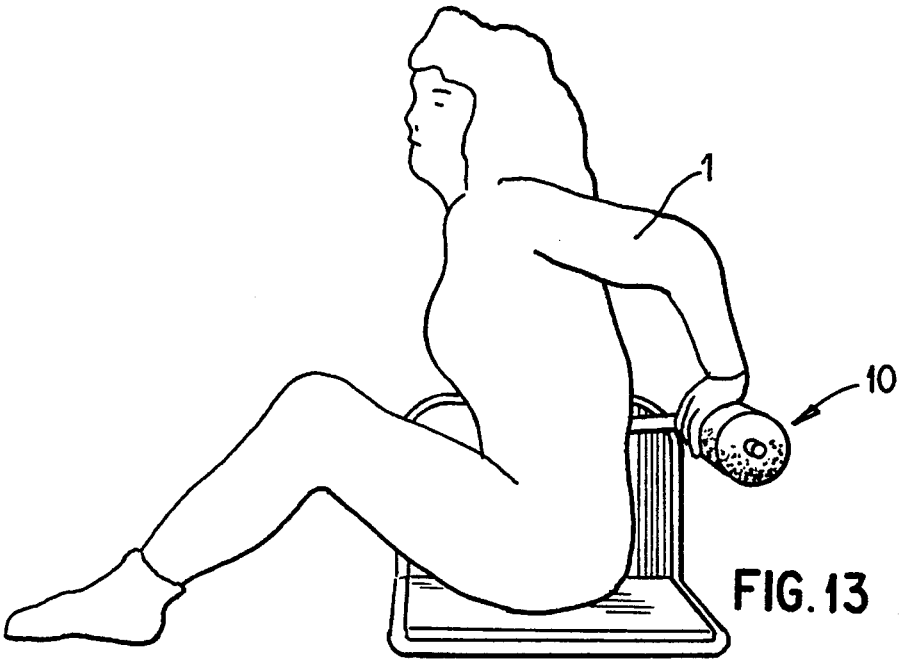
FIG. 13 is a front perspective view of a user performing a fourth exercise on the preferred embodiment of the present invention; and, FIG. 14 is a front perspective view of a user performing a fifth exercise on the preferred embodiment of the present invention.
Figure 14:
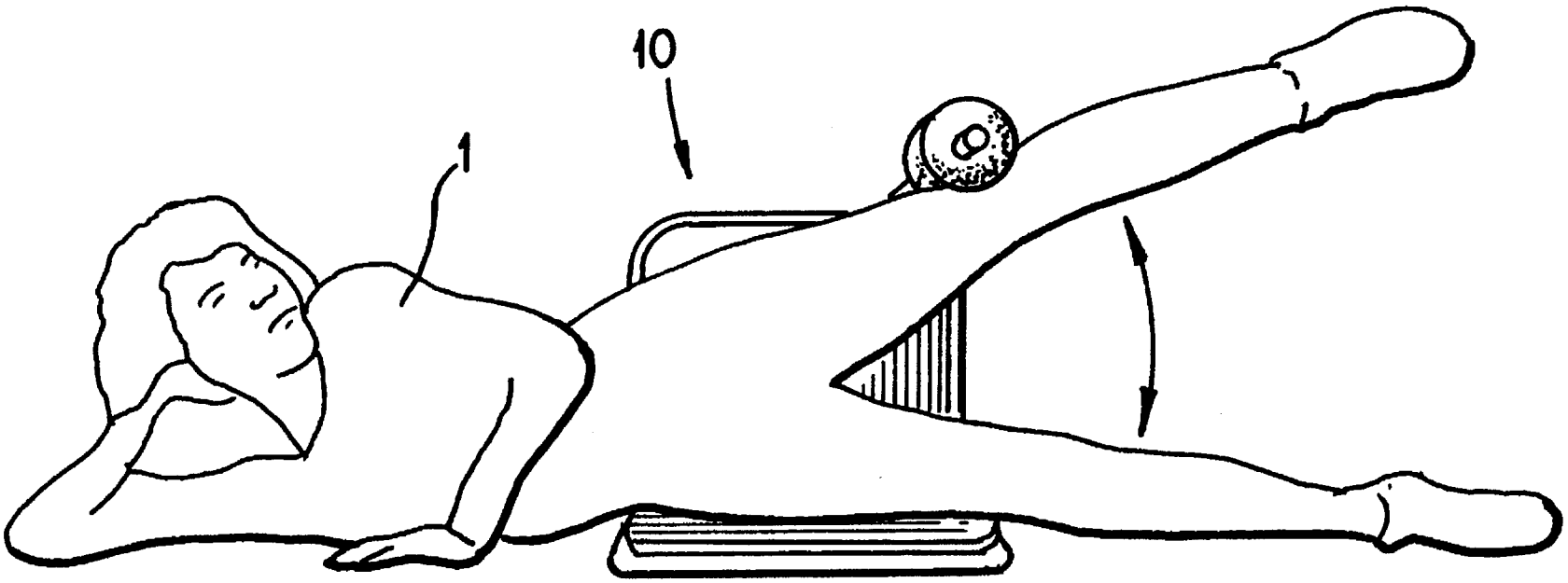

It should be noted that flexible tension members 60 and 60' may be coupled to the second portion 55 of rotation transfer member 50 by other suitable pivotal coupling means 56. One such means is shown in FIG. 9 wherein coupling means 56 comprises a disk member rotatably secured to second portion 55 of rotation transfer member 50 by a pivotal coupling pin 56'. Pivotal coupling disk 56 is freely rotatable along the direction indicated by the numeral 16 about the axis of pivotal coupling pin 56' and has formed on its side edge portion a pair of coupling formations 59 and 59' for engaging the ends, respectively, of flexible tension members 60 and 60'. As rotation transfer member 50 goes about its pivotal movement responsive to the user-applied force, the rotation of pivotal coupling disk 56 to accommodate the resistive forces imparted by flexible tension members 60 and 60' prevents both the formation of unnecessary tensile forces on flexible tension members 60 and 60' and the motion-disruptive coiling of those tension members 60, 60' about rotation transfer member 50.

Turning now to FIGS. 10–14, there are shown representative ones of numerous different exercises that may be performed by a user 1 on portable multi-exercise system 10. By adjusting the initial angular position of actuation bar 44 relative to actuation disk 41, and repositioning her body accordingly, user i may perform a wide variety of exercises. As illustrated in FIGS. 10–14, many different exercises may even be performed without reconfiguring portable multi-exercise system 10. Resistive force is encountered by user 1 regardless of the rotational direction along which she applies force. User 1 may, therefore, perform various 'pushing' and 'pulling' exercises to develop different muscles of her body with one system configuration. After she has exhausted all the exercises she wishes to perform with that system configuration, user 1 may reset the initial angular position of actuation bar 44 to thereafter perform a different set of exercises enabled by the new system configuration.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A portable multi-exercise system for providing a resistive force responsive to a force applied by a user, comprising:

a. a base frame member having a substantially planar bottom frame portion and a back frame portion;

b. rotation actuation means coupled to said back frame portion of said base frame member adjacent an upper end thereof, said rotation actuation means having a rotational axis, said rotation actuation means reversibly imparting a torque about said rotational axis responsive to a user applied force;

c. a rotation transfer member fixedly coupled to said rotation actuation means, said rotation transfer member having first and second portions, said first portion being disposed adjacent said rotational axis of said rotation actuation means and coaxially secured thereto, said second portion being disposed distal from said first portion, said second portion having a ring-shaped section; and, d. first and second flexible tension members coupled to said base frame member adjacent said bottom frame portion and said second portion of said rotation transfer member for providing said resistive force in either of two opposing directions in opposition to said torque reversibly imparted by said rotation actuation means, said first and second tension members each having an end portion slidingly coupled to said ring-shaped section of said rotation transfer member, said first tension member imparting at least one component of force opposing a component of force imparted by said second tension member.

2. The portable multi-exercise system as recited in claim 1 wherein each said first and second tension members is releasably secured to said base frame member and said ring-shaped section of said rotation transfer member.

3. The portable multi-exercise system as recited in claim 2 wherein said portable multi-exercise system includes a plurality of hook members, each of said hook members being secured to a respective one of said end portions of each said first and second tension members, each said hook member releasably engaging said ring-shaped section of said second portion of said rotation transfer member.

4. The portable multi-exercise system as recited in claim 1 wherein said first and second tension members are formed of an elastic composition.

5. The portable multi-exercise system as recited in claim 1 wherein said rotation actuation means includes an actuation member rotatably mounted to said back frame portion of said base frame member and an actuation bar angularly adjustably secured to said actuation member, said actuation bar having a lateral portion extending along a plane substantially parallel said bottom frame portion of said base frame member and spaced from both said rotational axis and said bottom frame portion of said base frame member.

6. The portable multi-exercise system as recited in claim 1 wherein said back frame portion of said base frame member is releasably secured to said bottom frame member of said base frame member.

7. A portable multi-exercise system for providing a resistive force responsive to a force applied by a user comprising:

a. a base frame member having a substantially planar bottom frame portion and a back frame portion;

b. rotation actuation means coupled to said back frame portion of said base frame member, said rotation actuation means having a rotational axis, said rotation actuation means reversibly imparting a torque about said rotational axis responsive to a user applied force;

c. a rotation transfer member fixedly coupled to said rotation actuation means, said rotation transfer member having first and second portions, said first portion being disposed adjacent said rotational axis of said rotation actuation means and coaxially secured thereto, said second portion being disposed distal from said first portion; and, d. first and second flexible tension members coupled to said base frame member and said second portion of said rotation transfer member for providing said resistive force opposing said torque reversibly imparted by said rotation actuation means, said first and second tension members each having an end portion pivotally coupled to said second portion of said rotation transfer member, said first tension member imparting at least one component of force opposing a component of force imparted by said second tension member, said rotation transfer member including a pivot member rotatably coupled to said second portion thereof, said pivot member being releasably secured to said end portion of each said first and second tension members.

8. A portable multi-exercise system for providing a resistive force responsive to a force applied by a user, comprising:

a. a base frame member having a substantially planar bottom frame portion and a back frame portion;

b. rotation actuation means coupled to said back frame portion of said base frame member adjacent an upper end thereof, said rotation actuation means having a rotational axis, said rotation actuation means reversibly imparting a torque about said rotational axis responsive to a user applied force;

c. a rotation transfer member fixedly coupled to said rotation actuation means, said rotation transfer member having first and second portions, said first portion being disposed adjacent said rotational axis of said rotation actuation means and coaxially secured thereto, said second portion being disposed distal from said first portion; and, d. a first flexible tension member having a first end portion coupled to said base frame member adjacent said bottom frame portion and a second end portion coupled to said second portion of said rotation transfer member for providing said resistive force opposing said torque reversibly imparted by said rotation actuation means, said second end portion of said first tension member being arcuately slidingly coupled to said second portion of said rotation transfer member with respect to said first end portion thereof.

9. The portable multi-exercise system as recited in claim 8 further comprising a second flexible tension member having a first end portion coupled to said base frame member adjacent said bottom frame portion and spaced from said coupling of said first flexible tension member to said base frame member, said second flexible tension member having a second end portion coupled to said second portion of said rotation transfer member for providing said resistive force opposing said torque reversibly imparted by said rotation actuation means in a direction opposite said first flexible tension member, said second end portion of said second tension member being arcuately slidingly coupled to said second portion of said rotation transfer member with respect to said first end portion thereof.

10. The portable multi-exercise system as recited in claim 8 where said second portion of said rotation transfer member includes a ring-shaped section formed on a distal end thereof and slidingly engaged by said second end of said first flexible tension member.

11. The portable multi-exercise system as recited in claim 8 wherein said rotation actuation means includes an actuation member rotatably mounted to said back frame portion of said base frame member and an actuation bar angularly adjustably secured to said actuation member, said actuation bar having a lateral portion extending along a plane substantially parallel said bottom frame portion of said base frame member and spaced from both said rotational axis and said bottom frame portion of said base frame member.

* * * * *